US005792243A

United States Patent [19]

Meffert et al.

[11] Patent Number: 5,792,243

[45] Date of Patent: Aug. 11, 1998

[54] SPRAYING ELECTRODE FOR ELECTROSTATIC SEPARATORS FORMED BY A SUPPORT OF NON-CONDUCTIVE MATERIALS WITH A FABRIC OF CROSSED AND TWISTED THREADS OF CARBON FIBERS ON ITS OUTER SIDE AND USE OF THE SPRAYING ELECTRODE

[75] Inventors: Heinz Meffert, Frankfurt am Main; Georg Leluschko, Rödermark; Heinz Kunoff, Frankfurt am Main, all of Germany

[73] Assignee: Metallgesellschaft Aktiengesellschaft, Frankfurt am Main, Germany

[21] Appl. No.: 602,751

[22] PCT Filed: Jul. 12, 1994

[86] PCT No.: PCT/EP94/02275

§ 371 Date: Apr. 1, 1996

§ 102(e) Date: Apr. 1, 1996

[87] PCT Pub. No.: WO95/04601

PCT Pub. Date: Feb. 16, 1995

[30] Foreign Application Priority Data

Aug. 11, 1993 [DE] Germany ..... 43 26 895.1

[51] Int. Cl.[6] ..... B03C 3/41

[52] U.S. Cl. ..... 96/83; 96/96; 313/355

[58] Field of Search ..... 96/16, 17, 96, 96/97, 92–95, 99, 83, 88, 98; 95/59; 361/226; 313/352, 355

[56] References Cited

U.S. PATENT DOCUMENTS

| | | | |
|---|---|---|---|
| 913,941 | 3/1909 | Blake | 96/96 |
| 1,067,974 | 7/1913 | Cottrell | 96/96 X |
| 1,130,215 | 3/1915 | Steere | 201/40 X |
| 1,428,839 | 9/1922 | Fortescue | 96/96 X |
| 1,650,097 | 11/1927 | Schmidt | 96/95 |
| 2,593,869 | 4/1952 | Fruth | 96/96 X |
| 4,098,591 | 7/1978 | van Diepenbroek et al. | 96/97 X |
| 5,296,019 | 3/1994 | Oakley et al. | 96/95 |

FOREIGN PATENT DOCUMENTS

| | | | |
|---|---|---|---|
| 0031623 | 7/1981 | European Pat. Off. . | |
| 1694459 | 3/1955 | Germany . | |
| 1102107 | 3/1961 | Germany | 96/97 |
| 2311468 | 9/1974 | Germany . | |
| 2311468B2 | 9/1974 | Germany . | |
| 2518952 | 12/1975 | Germany . | |
| 2500888 | 7/1976 | Germany . | |
| 2851757 | 6/1980 | Germany . | |
| 63-143918 | 6/1988 | Japan | 96/95 |
| 937022 | 6/1982 | U.S.S.R. | 96/95 |
| 734207 | 7/1955 | United Kingdom | 96/95 |

*Primary Examiner*—Richard L. Chiesa
*Attorney, Agent, or Firm*—Michael J. Striker

[57] ABSTRACT

A discharge electrode for electrostatic precipitators has a support composed of an electrically non-conductive material, a fabric composed of crossed and twisted threads and disposed on an exterior of the support, the support having an upper end and a lower end, and further comprising an additional layer of a synthetic elastomer which covers at least one of the ends over a length of 400–600 mm. Also, an electrostatic precipitator for treatment of exhaust gasses containing $SO_2$, $SO_3$, HF or HCL is proposed with the new discharge electrode.

11 Claims, 1 Drawing Sheet

SPRAYING ELECTRODE FOR ELECTROSTATIC SEPARATORS FORMED BY A SUPPORT OF NON-CONDUCTIVE MATERIALS WITH A FABRIC OF CROSSED AND TWISTED THREADS OF CARBON FIBERS ON ITS OUTER SIDE AND USE OF THE SPRAYING ELECTRODE

BACKGROUND OF THE INVENTION

The invention relates to a discharge electrode for electrostatic precipitators, which consists of a support of non-conductive materials on whose exterior a fabric of crossed and twisted threads of carbon fibers is disposed, and to the use of the discharge electrode.

Various types of electrodes are known. Discharge electrodes and precipitation electrodes, which are made of carbon, are described in DE-OS 28 51 757 and DE-AS 23 11 468. The carbon is employed there in the form of fabrics, felts and threads.

A precipitation electrode for electric precipitators, which has a foil of carbon permanently connected with a support on its electrically conducting surface, is described in DE-PS 25 00 888. The carbon foil is made of pressed graphite, while the support can consist of a plastic material.

An electrode consisting of an electrically conducting support, on which a fiber material made of a dielectric substance is disposed, is described in EP 0 031 623 A1.

An acid-resistance discharge electrode for electric filters is described in DE-GB 1 694 459, which consists of an acid-resistant non-metallic support body and an acid-resistant metal as the discharge member, wherein metal foils, in particular of noble metals, are disposed on the support body in such a way that the foils form discharge peaks or discharge edges on the surface of the support body.

An electrode consisting of a perforated support on whose surface carbon is disposed is described in U.S. Pat. No. 1,130,215. In this case the carbon is employed in powder form and forms discharge peaks on the exterior.

A device for the removal of solid or liquid particles from a gas flow is described in DE-OS 25 18 952, wherein the gas flow is guided through a separating chamber which is delimited by two electrodes disposed opposite each other, and wherein an electrical field is generated between the electrodes, which is of such strength that essentially no ionization takes place in the gas flow. At least one of the electrodes of this device is provided with a coating consisting of a fiber material with limited electrical conductivity and having a large number of protruding thin fibers. The coating here can consist of asbestos fibers, glass fibers, textile fabric, stainless steel or fine metal fibers which are embedded in a plastic support.

SUMMARY OF THE INVENTION

The object on which the invention is based is to provide a discharge electrode which is corrosion-resistant and which at the same time permits an electrostatic charge of the solid and/or liquid particles contained in the gas in the corona for electrostatic precipitation.

In keeping with these objects and with others which will become apparent hereinafter, one feature of the present invention resides, briefly stated, in a discharge electrode for electrostatic precipitators which has a support of non-conductive materials with a fabric of crossed and twisted threads of carbon fibers arranged in its outer side, wherein in accordance with the present invention the upper end and/or the lower end in a length of 400–600 mm are covered with an additional layer with synthetic elastomers. In this case the support is made in an advantageous manner of plastic materials or caoutchouc. In an advantageous manner the carbon fibers are made of graphite and have a diameter between 5 and 10 μm. Dry or wet operating electric filters can be employed as electrostatic precipitators. It has been shown in a surprising manner that the fabric made of crossed and twisted threads of carbon fibers and disposed on the exterior of electrically non-conduction materials makes possible a corona, by means of which solid or liquid particles contained in the exhaust gas are electrostatically charged and precipitated at the precipitation electrodes. The discharge electrode is markedly corrosion-resistant and is therefore suited for relatively long working periods.

A preferred embodiment of the invention consists in that the threads respectively consist of 2400 to 2600 carbon fibers. It is possible to create the fabric from these thread in a relatively simple manner by means of the bobbin lace method. The bobbin lace method is understood to be the patterned crossing and twisting of twined threads, which as a rule today is automatically performed with modern machines. If the threads consist respectively of 2400 to 3600 carbon fibers, the effect of the individual fabric sections as discharge peaks is increased and a homogeneous formation of the corona is made easier.

In accordance with a further preferred embodiment of the invention the fabric has an average thickness between 0.3 to 0.7 mm. Because of this step the exterior of the discharge electrode has a relatively great mechanical stability.

A further preferred embodiment of the invention consists in that the support has a core of aramid. Aramids are understood to be the aromatic polyamides of aromatic diamines and arylene dicarboxylic acids. The tensile strength of the discharge electrode is considerably increased in a relatively simple manner if the support contains a core of aramid, so that the arrangement of weights, which as a rule are 2 to 5 kg, can take place relatively quickly, and the discharge electrode can be employed in an advantageous manner even at particularly high gas velocities.

In accordance with a further embodiment of the invention the core has a circular cross section with a diameter of 1 to 3 mm. A core with a circular cross section of a diameter of 1 to 3 mm can be worked into the support in a relatively simple manner. This simplifies the production of the discharge electrode, wherein a relatively great tensile strength of the discharge electrode can be simultaneously achieved.

In accordance with a further preferred embodiment of the invention the support or the unit of core and support has a circular cross section of a diameter of 5 to 10 mm. This step makes an even arrangement of the fabric of crossed and twisted threads of carbon fibers on the outside of the support possible, wherein it is simultaneously possible to form an even corona over the entire effective length of the discharge electrode.

Butyl caoutchouc, for example, can be employed as synthetic elastomer. The synthetic elastomers can be applied by vulcanization on the upper and/or lower end. As a rule, spark erosion often occurs at the upper and/or the lower end of discharge electrodes because of the field and reduces the precipitation output of the electrostatic precipitator. If the upper end and/or the lower end are enclosed over a length between 400 and 600 mm with an additional layer of a synthetic elastomer, this undesired spark erosion can be prevented and the efficiency of the electrostatic precipitator can be increased.

In accordance with a further embodiment of the invention the lower portion of the lower end has at least one protrusion crosswise in respect to the longitudinal axis of the discharge electrode. This step allows a relatively simple application of weights for stabilizing the discharge electrode.

In accordance with a further preferred embodiment of the invention the upper end has an eye. In this way it is possible to arrange the discharge electrode relatively easily in the electrostatic precipitator. This step also allows a relatively problem-free retrofitting of electrostatic precipitators by means of the additional simple disposition of further discharge electrodes, which might be possibly required if the values of the exhaust gases to be treated fluctuate to a greater extent.

Finally, an object of the invention is the use of the discharge electrode for the treatment of exhaust gases containing $SO_2$ or $SO_3$ or HF or HCl or mixtures thereof in electrostatic precipitators. In this case it is advantageous that it is possible to free larger amounts of exhaust gases, containing $SO_2$ or $SO_3$ or HF or HCl or mixtures thereof, of the harmful acid substances, and that the discharge electrode does not show corrosive damage because of $SO_2$ or $SO_3$ or HF or HCl or mixtures thereof.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
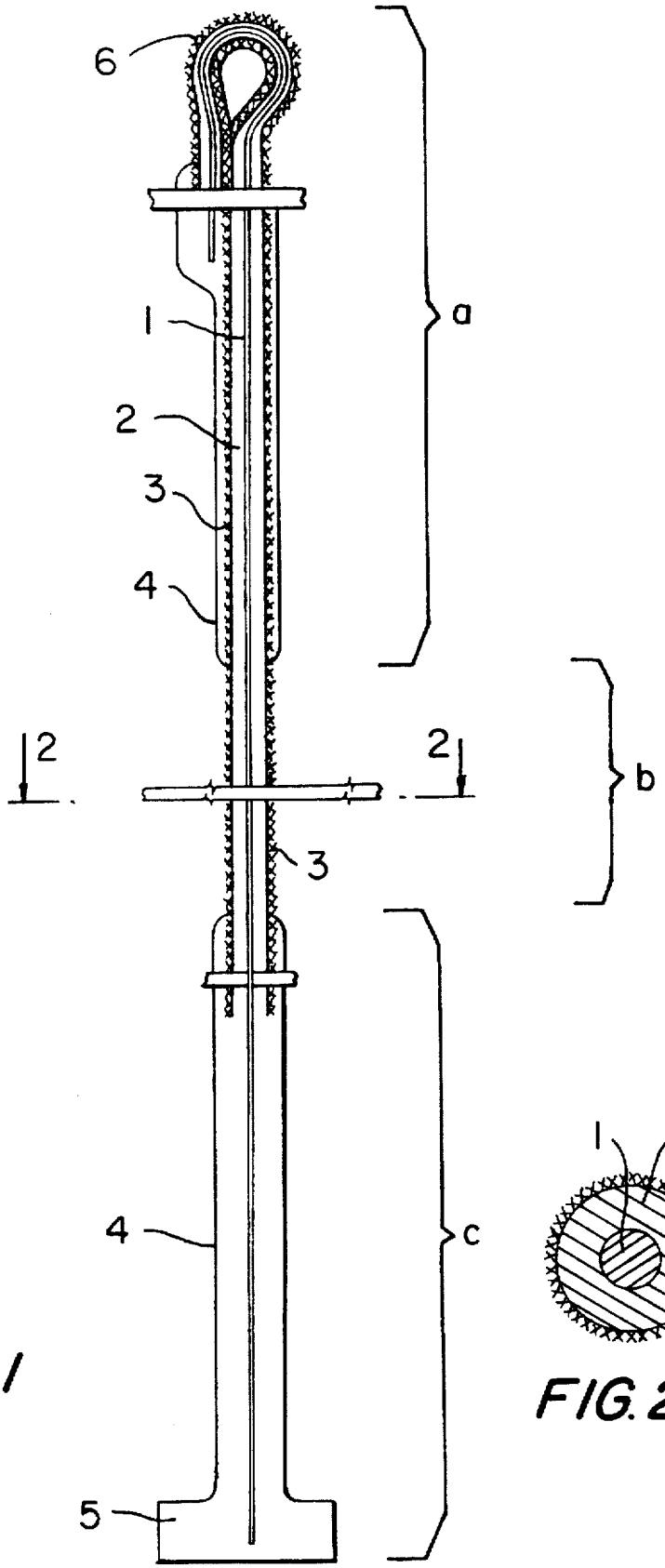
FIG. 1 shows a longitudinal sectional view through the discharge electrode for electrostatic precipitators.
Figure 2:
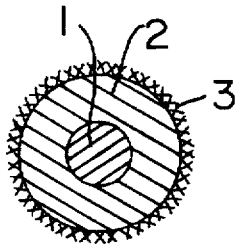
FIG. 2 shows the discharge electrode for electrostatic precipitators in a cross-sectional view along the section A—A in FIG. 1.

The discharge electrode for electrostatic precipitators is shown in a longitudinal sectional view in FIG. 1. The discharge electrode is divided into an upper end a, a central element b and a lower end c. The central element b is used to form the corona required for the electrostatic precipitation. A core (1) surrounded by a support (2) is disposed centered in the discharge electrode. The core (1) preferably consists of aramid. The support (2) preferably consists of synthetic elastomers. A fabric (3) of crossed and twisted threads made of carbon fibers is disposed on the outside of the electrically non-conductive support (2). The upper end a and the lower end c are covered with an additional layer (4) of synthetic elastomers. A protrusion (5) crosswise in respect to the longitudinal axis of the discharge electrode is disposed at the lower portion of the lower end c. Weights can be disposed in a relatively simple manner on this protrusion (5). The upper end a has an eye (6), by means of which the discharge electrode can be disposed in a relatively easy manner in the upper part of the electrostatic precipitator The cross section of the discharge electrode in accordance with the section A—A in FIG. 1 is represented in FIG. 2. An electrically non-conducting support (2) is arranged around the core (1), which preferably is made of aramid. The unit of core (1) and support (2) has a circular cross section. A fabric (3) of crossed and twisted threads of carbon fibers is disposed on the exterior of the support (2).

The invention will be described in detail below by means of an example and a comparative example.

EXAMPLE

The exhaust gas created in the course of the combustion of garbage has a temperature of 78° C., a dew point of 78° C., a dust content of 2 g/m$^3$ and occurs in an amount of 30.000 m$^3$/h. Small amounts of $SO_2$, $SO_3$, HF and HCl are furthermore contained in the exhaust gas. The precipitation surface of the electrostatic precipitator is 500 m$^2$, wherein plate-shaped precipitation electrodes are utilized, which are disposed at a distance of 300 mm. Discharge electrodes are disposed in the centers between the plate-shaped precipitation electrodes at a distance of 400 mm from each other and have a total length of 5 m, while the center part has a length of 4.2 m. A core of aramid of a diameter of 2 mm is disposed centered in each discharge electrode. A support of synthetic elastomers is arranged around the core of each discharge electrode. The unit of core and support of each discharge electrode has a circular diameter of 8 mm. A fabric of crossed and twisted thread of carbon fibers is disposed on the exterior of each support. The fabric has a thickness of 0.5 mm. The upper ends and the lower ends of the individual discharge electrodes are enclosed with an additional layer of synthetic elastomers over a length of 0.5 m. The lower parts of the lower ends have a protrusion crosswise in respect to the longitudinal axis of the discharge electrode, on which a respective weight of 3 kg is disposed. The upper ends of the discharge electrodes have an eye, whose interior diameter is 11 mm and which is used to suspend the individual discharge electrodes. With a field strength in the range between 2 to 4 kV/cm, following the treatment of the exhaust gas a residual content of <10 mg/Nm$^3$ of dustlike materials was measured in the clean gas. The working period of the discharge electrodes can be up to four years without disadvantageous effects on the efficiency of the electrostatic precipitator being noted.

Comparative Example

An exhaust gas of the same composition as in the above example is treated under the same conditions in the same electrostatic precipitator. However, in contrast to the discharge electrodes recited in the example, discharge electrodes made of wires of noble metals are disposed in the electrostatic precipitators and centered between the plate-shaped starting sheets at the same distance as in the recited example. In contrast with the above example, the residual content of dustlike materials in the clean gas following treatment of the exhaust gas was 30 mg/Nm$^3$.

Thus, the discharge electrode for electrostatic precipitators in accordance with the invention also makes possible, besides its simple handling and corrosion resistance, an increase in the efficiency of the electrostatic precipitator, the cause of which is the even formation of the corona in the center part of the discharge electrode.

We claim:

1. A discharge electrode for electrostatic precipitators, comprising a support composed of an electrically non-conductive material; a fabric composed of crossed and twisted threads and disposed on an exterior of said support, said support having an upper end and a lower end; and further comprising an additional layer of a synthetic elastomer which covers at least one of said ends over a length of 400–600 mm.

2. A discharge electrode as defined in claim 1, wherein said additional layer covers each of said ends over a length of 400–600 mm.

3. A discharge electrode as defined in claim 1, wherein each of said threads consists of 2400–3600 carbon fibers.

4. A discharge electrode as defined in claim 1, wherein said fabric has an average thickness of 0.3–0.7 mm.

5. A discharge electrode as defined in claim 1, wherein said support has a core composed of aramid.

6. A discharge electrode as defined in claim 1, wherein said support has a core with a circular cross-section having a diameter of 1–3 mm.

7. A discharge electrode as defined in claim 1, wherein said support has a circular cross-section with a diameter of 5–10 mm.

8. A discharge electrode as defined in claim 1, wherein said support has a core and together with said core forms a unit with a circular cross-section having a diameter of 5–10 mm.

9. A discharge electrode as defined in claim 1, wherein said lower end has a lower part provided with at least one projection which extends transversely to a longitudinal axis of said support.

10. A discharge electrode as defined in claim 1, wherein said upper end has an eye.

11. An electrostatic precipitator for treatment of exhaust gasses containing a substance selected from the group consisting of $SO_2$, $SO_3$, HF and HCL, the electrostatic precipitator comprising a discharge electrode having a support composed of an electrically non-conductive material; a fabric composed of crossed and twisted threads and disposed on an exterior of said support, said support having an upper end and a lower end; and further comprising an additional layer of a synthetic elastomer which covers at least one of said ends over a length of 400–600 mm.

* * * * *